US006872102B2

(12) United States Patent
Cottle

(10) Patent No.: US 6,872,102 B2
(45) Date of Patent: Mar. 29, 2005

(54) PORTABLE POWER SUPPLY

(75) Inventor: William C. Cottle, St. Charles, MO (US)

(73) Assignee: Associated Equipment Corporation, St. Louis, MO (US)

( * ) Notice: Subject to any disclaimer, the term of this patent is extended or adjusted under 35 U.S.C. 154(b) by 0 days.

(21) Appl. No.: 10/439,834

(22) Filed: May 16, 2003

(65) Prior Publication Data

US 2004/0229499 A1 Nov. 18, 2004

(51) Int. Cl.[7] ..... H01R 4/48
(52) U.S. Cl. ..... 439/822; 320/105
(58) Field of Search ..... 439/822, 892, 439/759, 509, 729, 504; 320/105

(56) References Cited

U.S. PATENT DOCUMENTS

| | | | | |
|---|---|---|---|---|
| 906,370 A | * | 12/1908 | Beck | 439/822 |
| 1,965,151 A | | 7/1934 | Mueller | |
| 2,610,987 A | | 9/1952 | Betz | |
| 2,718,540 A | | 9/1955 | Betz | |
| 3,258,731 A | | 6/1966 | Still et al. | |
| D235,454 S | | 6/1975 | Lindow, Jr. | |
| 4,037,720 A | | 7/1977 | McGurk | |
| 4,161,682 A | | 7/1979 | Corvette | |
| 4,350,746 A | | 9/1982 | Chambers | |
| 4,483,910 A | | 11/1984 | Julian | |
| 4,740,169 A | | 4/1988 | Gordon | |
| 4,983,473 A | | 1/1991 | Smith | |
| D316,397 S | | 4/1991 | Herbert | |
| 5,166,478 A | | 11/1992 | Sprouse | |
| 5,183,407 A | | 2/1993 | Srol | |
| D334,560 S | | 4/1993 | Wilson | |
| 5,214,368 A | | 5/1993 | Wells | |
| D374,859 S | | 10/1996 | Guay et al. | |
| 5,589,292 A | | 12/1996 | Rozon | |
| 5,793,185 A | * | 8/1998 | Prelec et al. | 320/104 |
| 5,928,022 A | * | 7/1999 | Moeller | 439/197 |
| 6,002,235 A | | 12/1999 | Clore | |
| 6,155,870 A | * | 12/2000 | Valentine | 439/504 |
| 6,565,381 B1 | * | 5/2003 | Chou | 439/501 |

OTHER PUBLICATIONS

Associated Equipment Brochure, Form No. 700388, Rev. 10/00.

* cited by examiner

*Primary Examiner*—Ross Gushi
*Assistant Examiner*—Phuongchi Nguyen

(57) ABSTRACT

The present invention includes a portable power supply having a housing that encloses a battery. Booster cables protrude from the housing and are electrically connected to the battery. Electrical clamps are attached to the booster cables and may connect to electrical terminals. The housing may include a clamp anchor integral thereto. The clamp anchor may include an anchor base and an anchor finger, wherein the anchor finger is generally perpendicular to the anchor base. The electrical clamp may be secured on the clamp anchor. The present invention further includes a booster cable with an electrical clamp that has a clamp cover rotatably mounted on the electrical clamp. The clamp cover may cover some of the electrically conductive portions of the electrical clamp and/or provide additional positioning of the electrical clamp on the clamp anchor.

29 Claims, 9 Drawing Sheets

PORTABLE POWER SUPPLY

FIELD OF THE INVENTION

The present invention relates to a portable power supply.

BACKGROUND OF THE INVENTION

Portable power supplies provide convenience, safety, and utility. Portage power supplies may be used to power electronic items such as cellular phones, power tools, work lights, radios, CD players, etc. in remote locations. Moreover, portable power supplies may be equipped with booster cables and have sufficient power for jump starting or charging the batteries of cars, trucks, boats, recreational vehicles and/or tractors.

A technical problem common with many portable power supplies are exposed booster cable clamps. Booster cable clamps on a portable power supply having exposed electrically conductive surfaces may prove hazardous if electricity is accidentally discharged from the portable power supply.

Another technical problem with portable power supplies includes the storage of the bulky booster cables. The booster cables may be many feet in length. Unrestrained booster cables tend to tangle or catch on other items resulting in an inconvenience.

SUMMARY OF THE INVENTION

The present invention includes a portable power supply having a housing that encloses a battery. Booster cables protrude from the housing and are electrically connected to the battery. Electrical clamps are attached to the booster cables and may be connected to an electrical terminal or other electrical component for electrical charging. The housing may include a clamp anchor integral or attached thereto. The clamp anchor may include an anchor base and an anchor finger, wherein the anchor finger is generally perpendicular to the anchor base. The electrical clamp may be secured or positioned on the clamp anchor of the housing.

The present invention further includes a booster cable with an electrical clamp that has a clamp cover rotatably mounted on the electrical clamp. The clamp cover may cover at least some electrically conductive portions of the electrical clamp and/or provide additional positioning of the electrical clamp on the clamp anchor.

It is an aspect of the present invention to provide a portable power supply having a clamp anchor thereon for securing an electrical clamp to the portable power supply and to prevent tangling of the booster cable.

It is another aspect of the present invention to provide an electrical clamp with a rotatable clamp cover to cover at least some of the electrically conductive portions of the electrical clamp to reduce an accidental discharge of electricity.

These and other aspects and features of the present invention will be better understood and appreciated in the following detailed description of embodiments thereof selected for purposes of illustration and shown in the accompanying drawings.

DETAILED DESCRIPTION OF THE INVENTION

Figure 1:
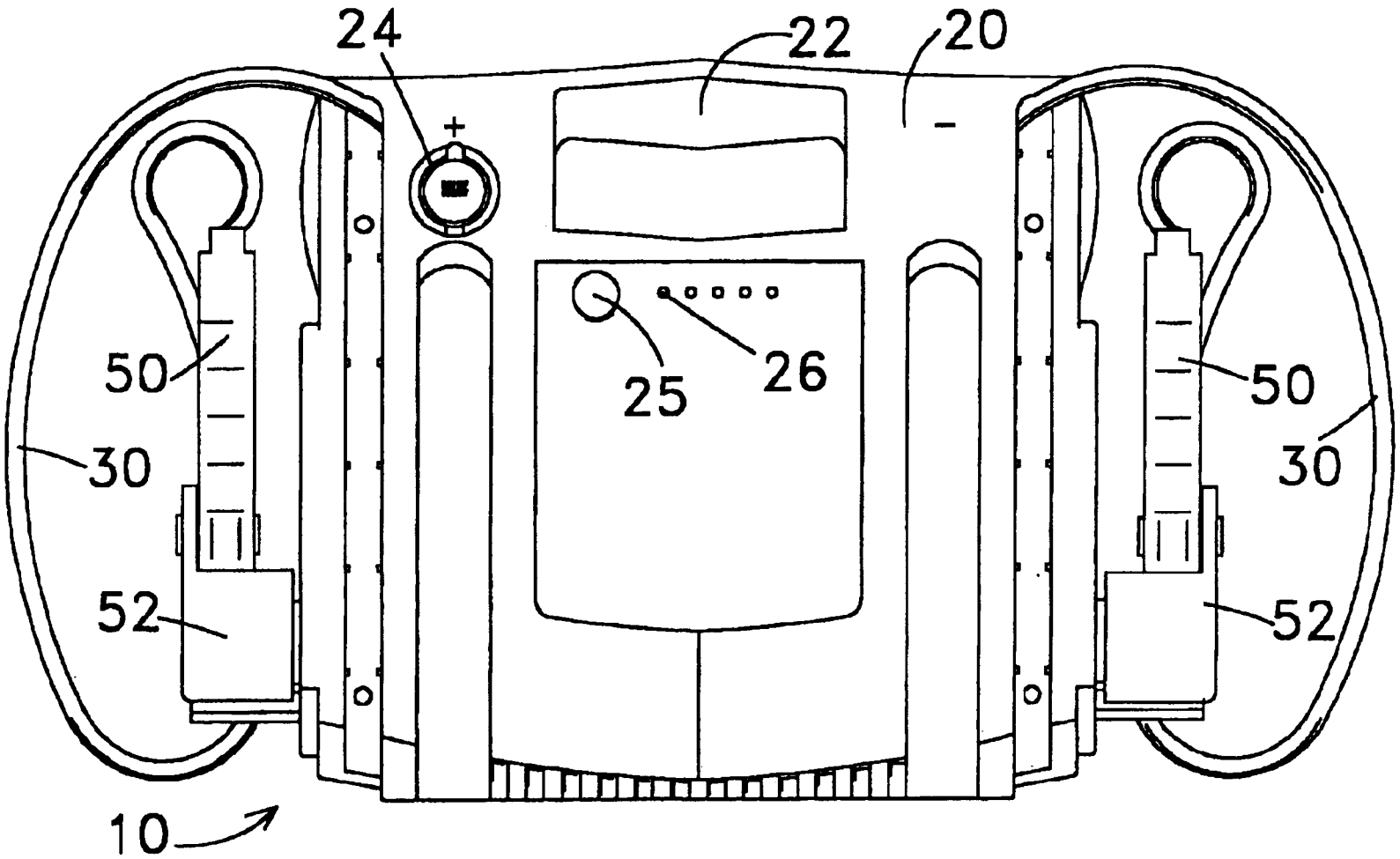
FIG. 1 is a front view of a portable power supply.
Figure 2:
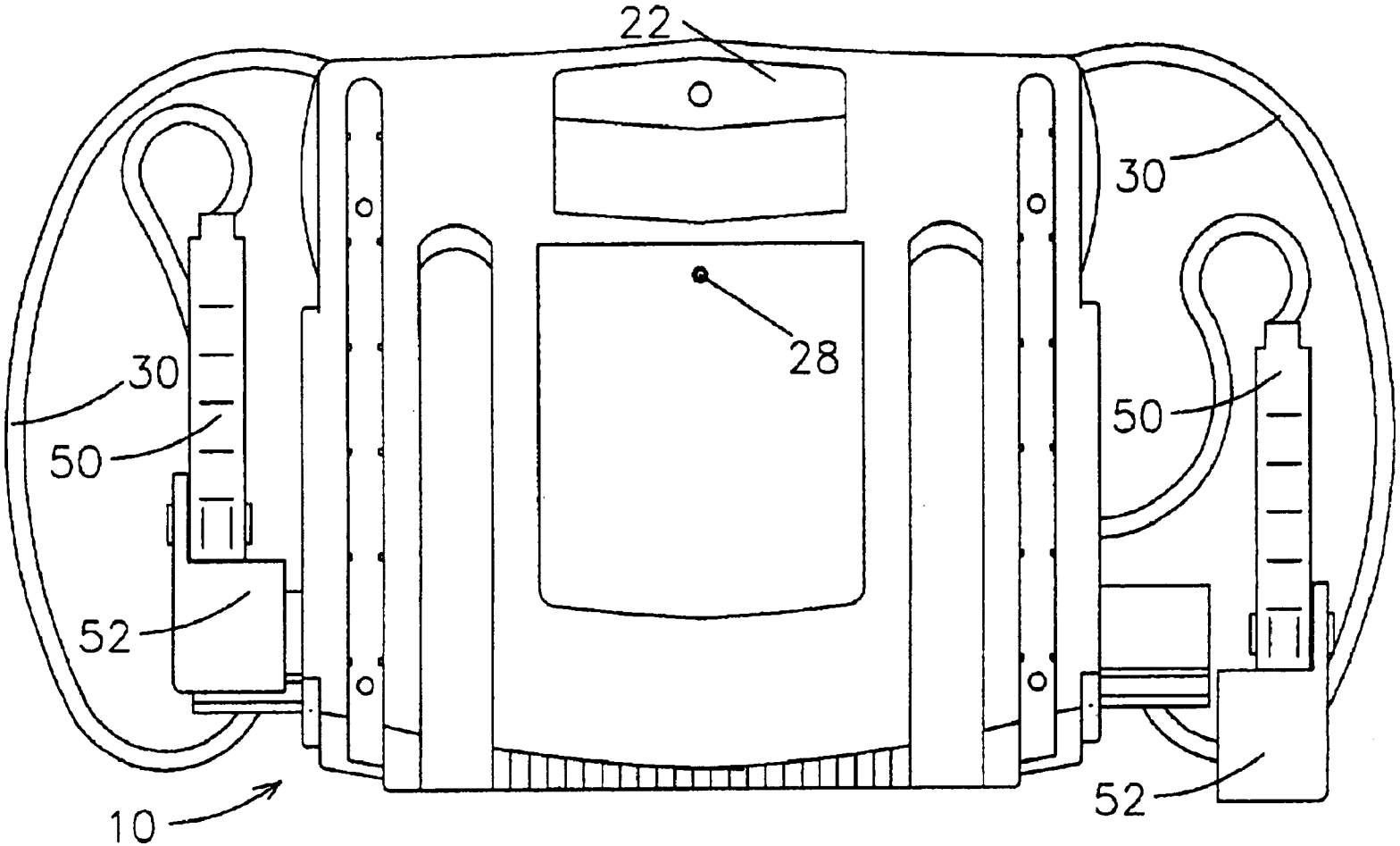
FIG. 2 is a rear view of the portable power supply.
Figure 3:
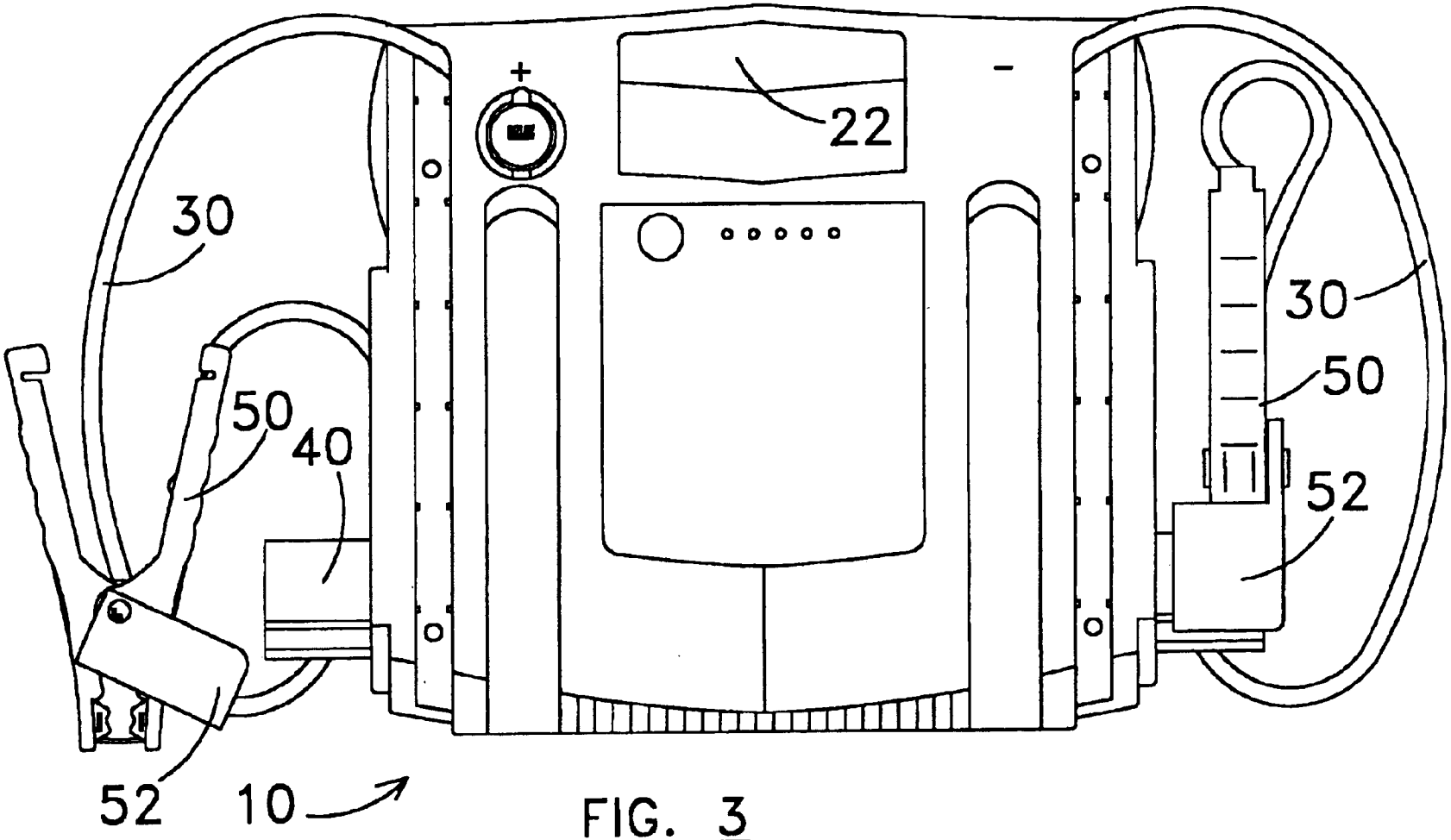
FIG. 3 is a front view of the portable power supply and a booster cable and an electrical clamp attached thereto.

A portable power supply of the present invention is shown in FIGS. 1–3. A portable power supply 10 includes a housing 20 of a lightweight, durable material. Preferably, the housing 20 is made of a hard plastic. The housing 20 preferably defines a handle 22. In other embodiments of the present invention, the handle may be a component that is fixedly attached or integral to the housing 20.

Booster cables 30 protrude from the housing 20. One of the booster cables 30 may attach to a positive terminal of a battery, via an electrical clamp 50, that is to be jump-started or recharged. Another booster cable 30 may attach to a negative terminal of the battery, via another electrical clamp 50, that is to be jump-started or recharged. The booster cables 30 may also attach to other electrical components as desired. Preferably, the booster cables 30 are constructed of a #4 gauge cable. In other embodiments, a #1 gauge cable is preferred.

The booster cables 30 include an electrically conductive wire surrounded by an insulating material. Typical electrically conductive wires are made from copper and other materials well known in the art. The insulating materials may include pvc and other materials well known in the art. The electrically conductive wire is electrically connected to the electrical clamp. An electrical clamp 50 is also shown in detail in FIGS. 10–12.

The construction of an electrical clamp is well known to one of ordinary skill in the art. In general, an electrical clamp includes handles and an electrically conductive portion. Preferably, the electrical clamp is made of an electrically conductive metal and is insulated by an insulating material except for the electrically conductive portion that is to be in contact with an electrical terminal or other electrical component.

The handles of an electrical clamp are generally rotatably mounted on a pin. A spring attached to the handles forces the electrically conductive portions of the handles together. The electrical clamp may have some shorter and longer electrically conductive surfaces protruding from the electrical clamp to provide better positioning and/or securing of the electrical clamp on the electrical terminal or other electrical component. The shorter electrically conductive surfaces may be referred to as "molars," whereas the longer electrically conductive surfaces may be referred to as "incisors."

The operation of an electrical clamp is well known to one of ordinary skill in the art. A force applied to the handles (such as a squeezing force from the hand of the operator) may overcome the force applied by the spring, wherein the electrically conductive portions are separated such that they will pinch or squeeze on the electrical terminal when the force applied to the handles is reduced or ended. Thus, the electrical clamp may be conveniently attached to and removed from electrical terminals.

In some embodiments of the present invention, a clamp cover is rotatably mounted on the pin of the electrical clamp. The clamp cover is generally made of a durable insulating material, such as plastic. The clamp cover may contain openings through which the pin passes through.

Some of the other parts and/or components of a portable power supply will now be discussed with reference to FIG. 1. The portable power supply 10 includes a DC port 24 that provides power to electrical devices operating on direct current. The portable power supply 10 may be transported to remote locations to provide electricity to a wide variety of electrical equipment.

The power supply 10 may also optionally include a test button 25 for testing a charge level of the power supply 10. The test button 25 may be pressed by the operator, and, consequently, an optional LED display 26 may indicate a charge level of the portable power supply 10.

Turning now to FIG. 2, a rear view of the power supply 10 is shown. An AC charging port 28 is integral to the housing 20. The AC charging port 28 may be connected to a source of alternating current to charge and recharge a battery contained within the housing 20. Preferably, a 500 milliamp AC 110 volt charger is connected to the AC charging port 28 for charging and recharging the battery. The power supply 10 may include circuitry and electrical components well known to one of ordinary skill in the art to prevent overcharging of the power supply 10.

The housing 20 encloses the battery. The battery is electrically connected to the DC port 24 and positive and negative booster cables 30 and the test button 25. Preferably, the battery is a sealed, maintenance free 12-volt battery which is connected to the positive and the negative booster cables 30 in the interior of the housing 20. A rechargeable lead-acid battery is particularly preferred. Preferably, the battery provides about 1650 amps and 360 cca boost power.

Turning now to FIG. 3, the booster cable 30 with the electrical clamp 50 and a clamp cover 52 is shown. The clamp cover 52 is rotatably connected to the electrical clamp 50 such that the clamp cover 52 may rotate to cover at least some of the metal conducting surfaces of the electrical clamp 50. The clamp cover 52 is preferably of a design such that during use of the electrical clamp 50, the clamp cover 52 may be rotated out of the way as to not interfere with the use of the electrical clamp 50. It is useful to cover the metal conductive surfaces of the electrical clamp 50 when the booster cable 30 or the power supply is in storage to reduce the likelihood of an accidental discharge of electricity. Preferably the clamps 50 are rated for approximately 400 amps.

Figure 4:
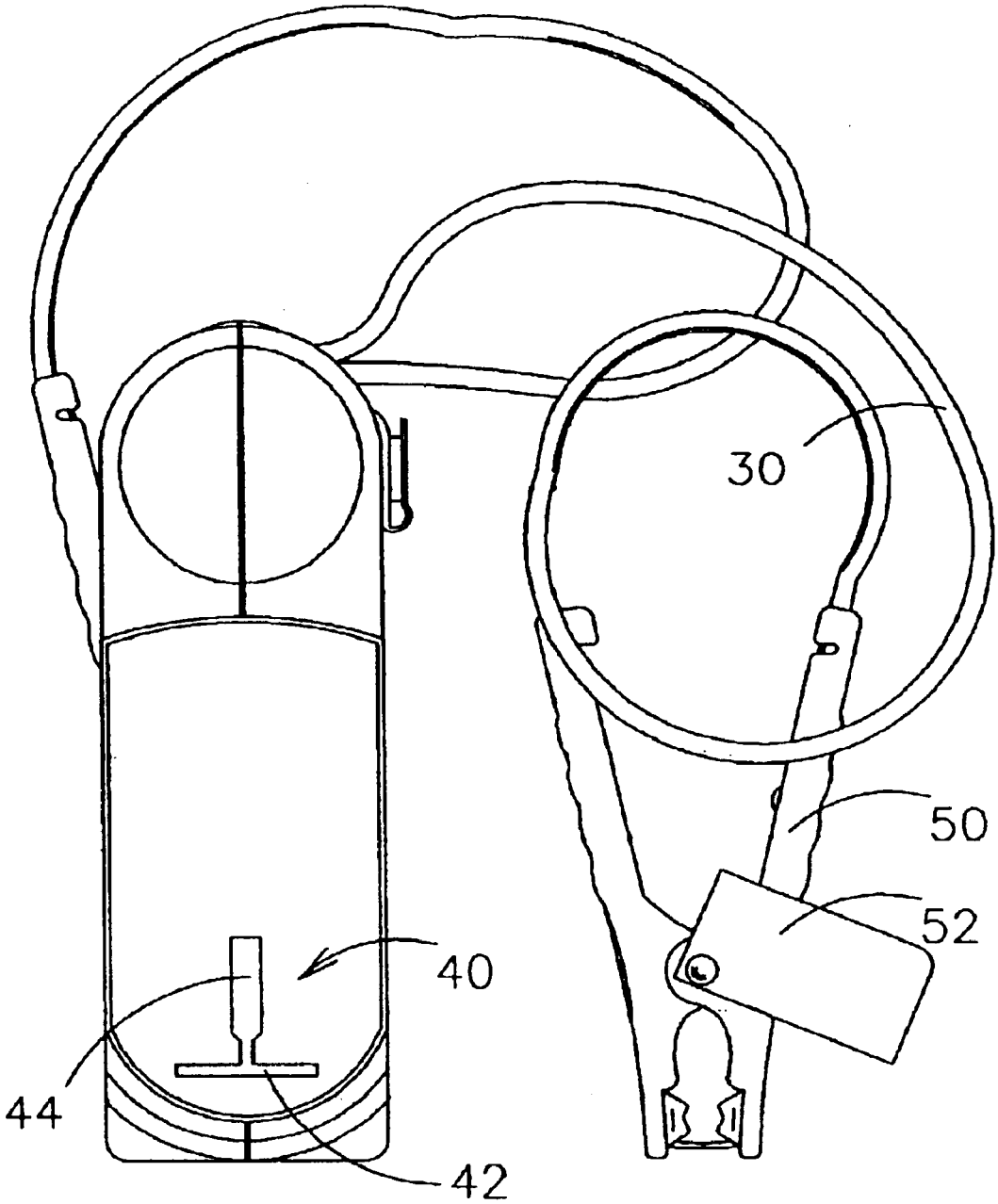
FIG. 4 is a side view of the portable power supply showing a clamp anchor.

Turning now to FIG. 4, a side view of the power supply 10 is shown. A clamp anchor 40 is attached on both sides of the power supply 10. The clamp anchor 40 may be integral to the housing 20 or may be fixedly attached to the housing 20. The clamp anchor 40 includes an anchor base 42 and an anchor finger 44.

Figure 5:
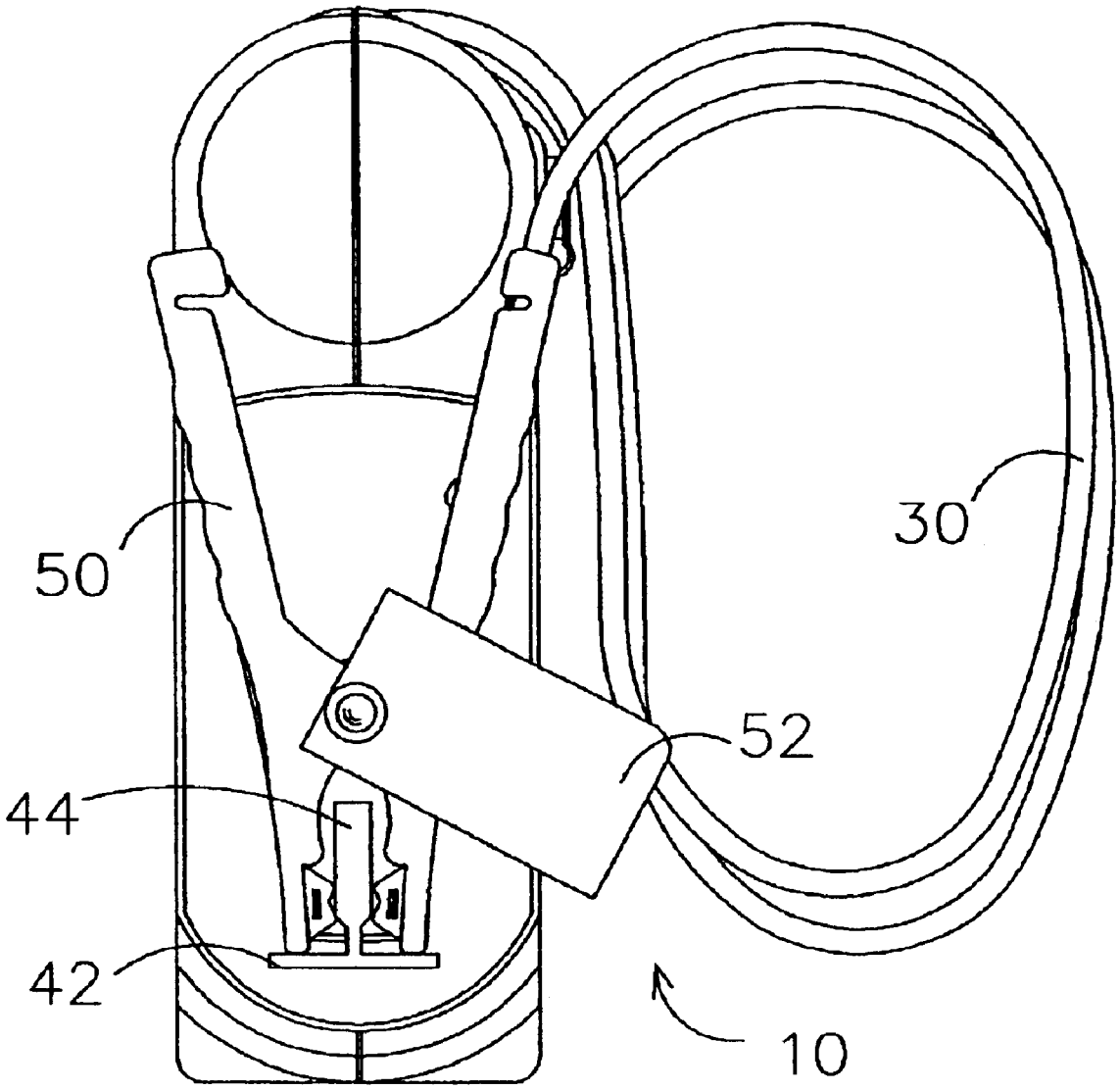
FIG. 5 is a side view of the portable power supply with the electrical clamp positioned on the clamp anchor and a clamp cover in an open position.

As shown in FIG. 5, the clamp anchor 40, the anchor base 42 and the anchor finger 44 receive the electrical clamp 50. The clamp anchor 40 is in the shape of an inverted "T." The electrical clamp 50 is secured and/or positioned on the clamp anchor 40. The electrical clamp 50 squeezes upon the anchor finger 44 and rests against the anchor base 42 to support the electrical clamp 50 and keep the electrical clamp 50 secure.

Figure 6:
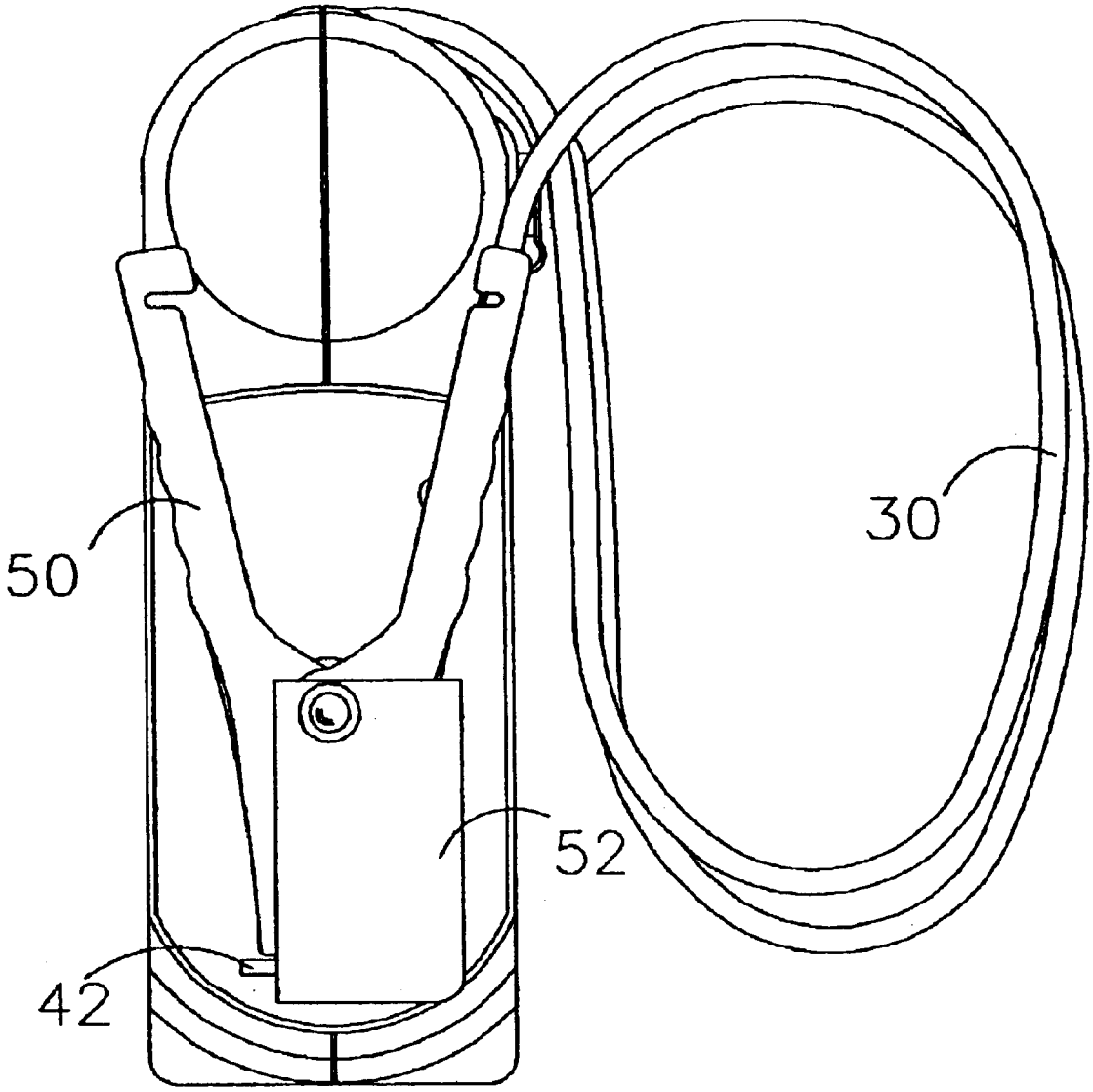
FIG. 6 is a side view of the portable power supply with the claim positioned on the clamp anchor with the clamp cover in a closed position.

As shown in FIG. 6, the clamp cover 52 may rotate and partially or wholly enclose the electrical clamp 50. Also shown in FIG. 6, the clamp cover 52 rotates and covers a portion of the anchor base 42. When the clamp cover 52 covers a portion of the anchor base 42, the clamp cover 52 provides further support for holding the electrical clamp 50 to the anchor base 42. Moreover, the clamp cover 52 provides an insulating cover over at least some of the metal conductive surfaces of the electrical clamp 50.

Figure 7:
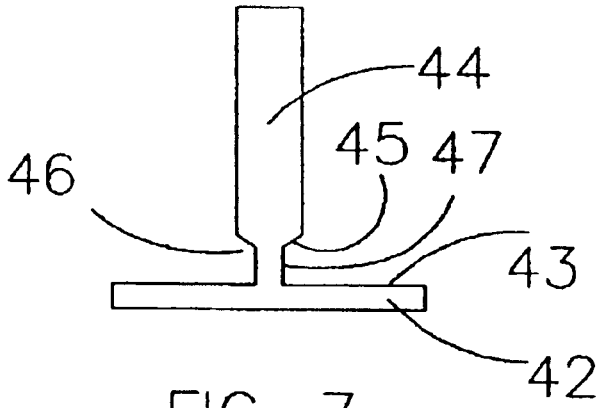
FIG. 7 is a front view of the clamp anchor.
Figure 8:
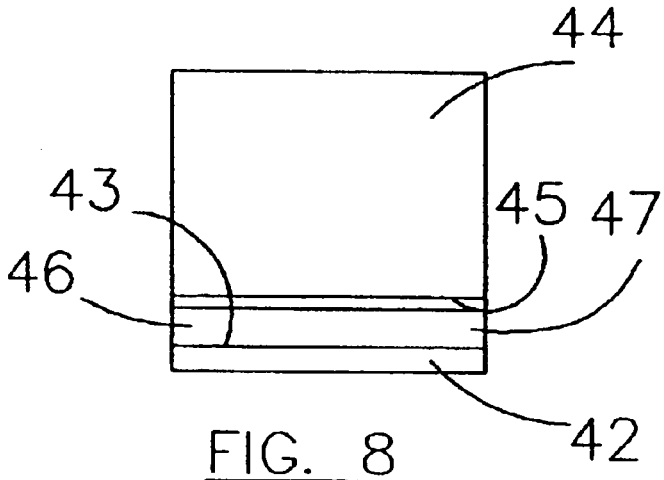
FIG. 8 is a side view of the clamp anchor.
Figure 9:
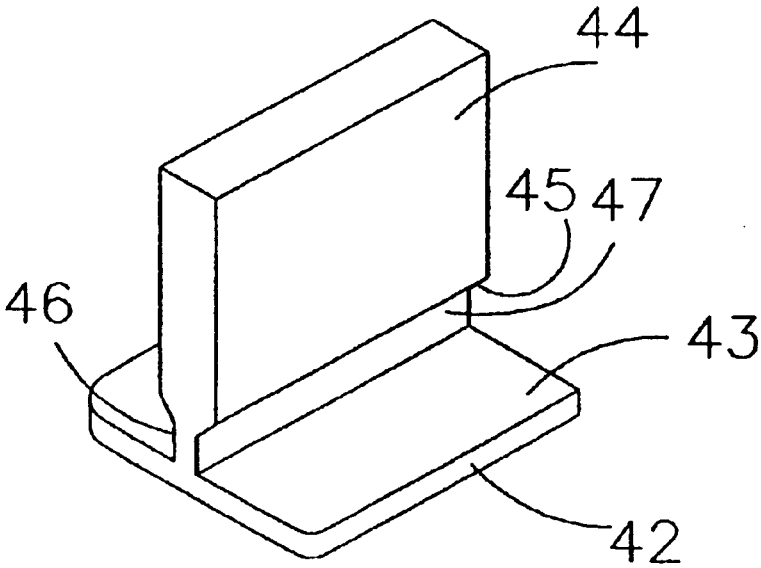
FIG. 9 is a perspective view of the clamp anchor.

Turning now to FIGS. 7–9, the clamp anchor 40 is shown in detail. The anchor base 42 includes a base surface 43, the anchor finger 44, a narrow finger region 47, a transition finger region 45, and a groove 46. The anchor finger 44 is generally perpendicular to the anchor base 42. It is important that a portion of the anchor finger 44 near the base surface 43 is narrower than the remainder of the anchor finger 44 to form the groove 46. The portion of the anchor finger 44 that is narrower than the remainder of the anchor finger 44 is shown as the narrow finger region 47. The portion of the anchor finger 44 where the anchor finger begins to narrow is shown as a transition finger region 45. The groove 46 is important to provide a secure connection between the electrical clamp 50 and the anchor base 42.

Figure 13:
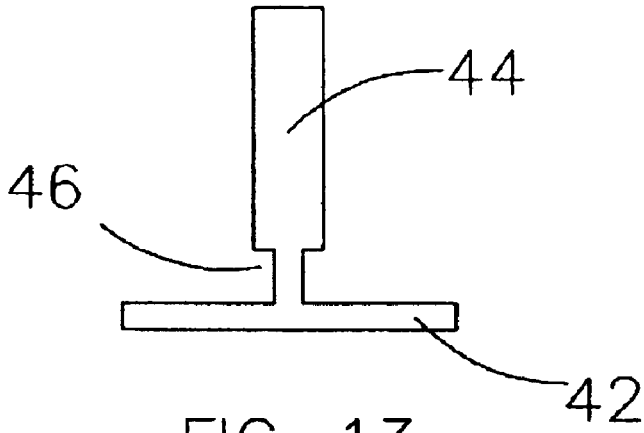
FIG. 13 is a front view of a clamp anchor with a box type groove.
Figure 14:
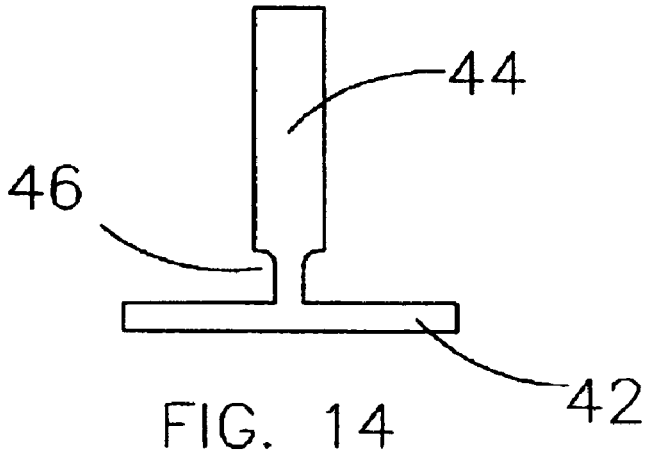
FIG. 14 is a front view of a clamp anchor with a curved type groove.

In another embodiment, as shown in FIG. 13, a box type groove 46 is employed. In a still further embodiment, as shown in FIG. 14, a curved type groove 46 is employed.

Figure 10:
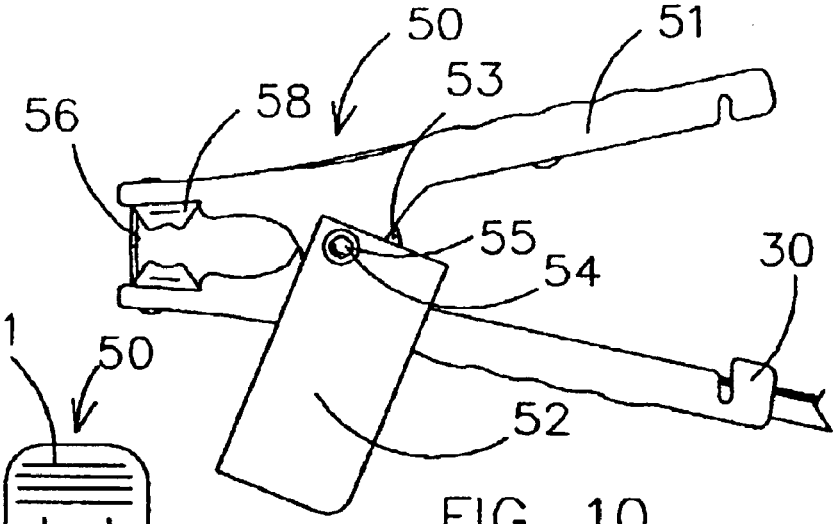
FIG. 10 is a side view of the clamp.
Figure 11:
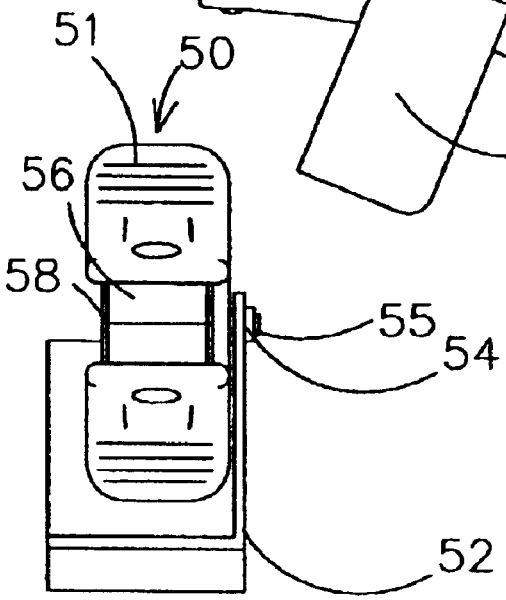
FIG. 11 is a front view of the clamp.
Figure 12:
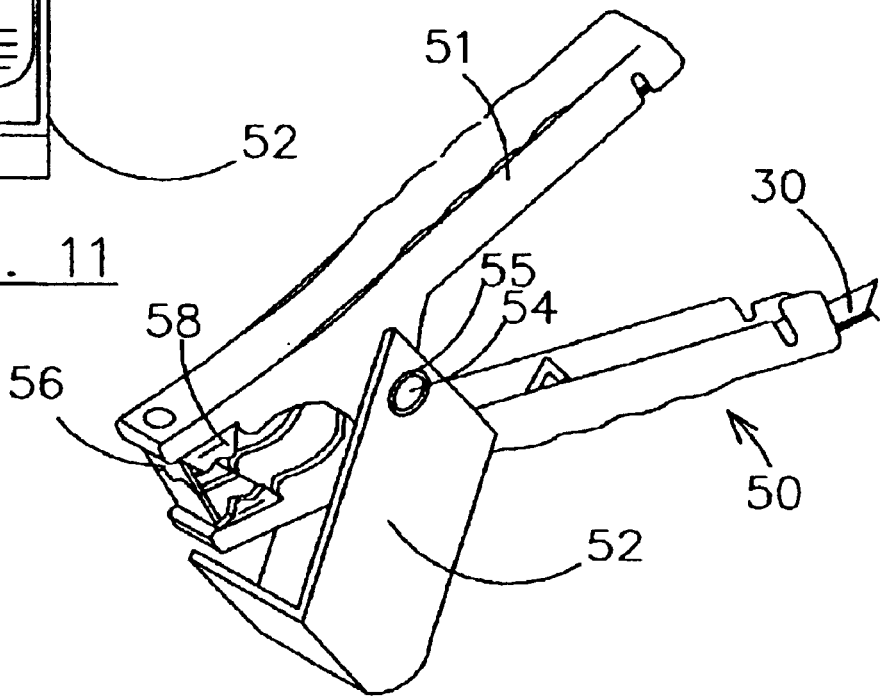
FIG. 12 is a perspective view of the clamp.

Turning now to FIGS. 10–12, the electrical clamp 50 is shown in detail. The electrical clamp 50 includes handles 51, a spring 53, a bushing 55, a pin 54, and the clamp cover 52. The handles 51 rotate about the pin 54 against the tension provided by the spring 53. The pin 54 and the bushing 55 hold the clamp cover 52 to the clamp. The clamp cover rotates on the pin 54.

The electrical clamp 50 also includes clamp incisors 56 and clamp molars 58. The clamp incisors 56 and the clamp molars 58 are made of a conductive metal to conduct electricity from the portable power supply 10 to the terminals of the battery being recharged or jump-started or other electrical component. As shown in FIGS. 10–12, the clamp incisors 56 generally protrude further from the electrical clamp 50 than the clamp molars 58. The groove 46 and the clamp anchor 40 accommodate this difference in the size of the clamp incisors 56 and the clamp molars 58. Since the clamp molars 58 are squeezed against the anchor finger 44 and the clamp incisors 56 are squeezed against the narrow finger region 47, the electrical clamp 50 securely squeezes on to the clamp anchor 40. Thus, the electrical clamp 50 is squeezing on two locations of the clamp anchor 40. Additionally, the clamp cover 52 provides further integrity to the positioning and securing of the electrical clamp 50 on the clamp anchor 40 since the clamp cover 52 rotates and covers at least a portion of the clamp anchor 40.

Figure 15:
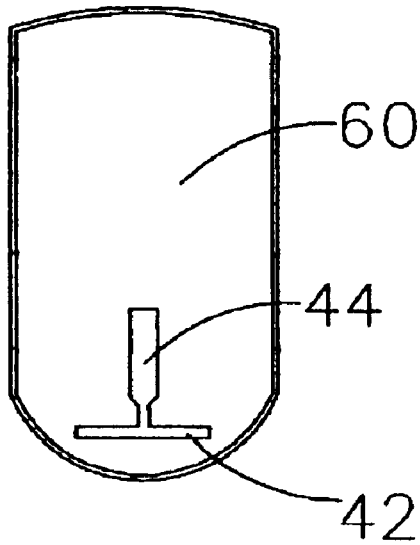
FIG. 15 is a front view of a retrofit anchor.

Another embodiment of the present invention is shown in FIG. 15. In this embodiment, a retrofit clamp anchor 60 is shown. The clamp anchor may fixedly attached to portable power supplies, battery chargers, booster cable storage devices, or any other device where securing and/or positioning an electrical clamp is useful.

In another embodiment of the present invention, the clamp anchor 40 may be rotated approximately 10° to approximately 45° on the housing 20. The squeezing action of the electrical clamp 50 is sufficient to secure the electrical clamp 50 on the clamp anchor 40 even at these angles.

What is claimed is:

1. A portable power supply, comprising:

a housing that encloses a battery;

booster cables protruding from the housing that are electrically connected to the battery;

electrical clamps connected to the booster cables, wherein the electrical clamps comprise a rotatable clamp cover; and a clamp anchor integral to the housing.

2. The portable power supply of claim 1, wherein the clamp anchor is fixedly attached to the housing.

3. The portable power supply of claim 1, wherein the clamp cover rotates to cover at least a portion of the clamp anchor.

4. The portable power supply of claim 1, wherein the clamp anchor comprises an anchor base and an anchor finger, wherein the anchor finger is generally perpendicular to the anchor base, wherein the electrical clamps are capable of being positioned or secured on the clamp anchor.

5. The portable power supply of claim 4, wherein the anchor finger comprises a narrow region that is narrower than the remainder of the anchor finger.

6. The portable power supply of claim 4, wherein the anchor finger has a groove therein formed by a transition region in the anchor finger that is narrower than the anchor finger.

7. The portable power supply of claim 4, wherein the anchor finger has a groove therein.

8. The portable power supply of claim 7, wherein the electrical clamps comprise longer and shorter electrically conductive surfaces, and wherein the longer electrically conductive surfaces squeeze against the groove in the anchor finger.

9. The portable power supply of claim 7, wherein the electrical clamps comprise longer and shorter electrically conductive surfaces, and wherein the longer electrically conductive surfaces squeeze against the groove in the anchor finger and the shorter electrically conductive surfaces squeeze against the anchor finger.

10. The portable power supply of claim 7, wherein the groove in the anchor finger is adjacent to the anchor base.

11. The portable power supply of claim 10, wherein the anchor finger comprises a box shaped groove or a curve shaped groove.

12. A booster cable, comprising:

an electrically conductive wire surrounded by an insulating material; and wherein the wire is electrically connected to an electrical clamp, comprising:

handles having an electrically conductive portion;

wherein the handles are rotatably mounted on a pin;

wherein the electrically conductive portions are forced together by a spring; and wherein a clamp cover is rotatably mounted on the pin.

13. The booster cable according to claim 12, wherein the clamp cover is capable of covering at least some of the electrically conductive portion.

14. An electrical clamp, comprising:

handles having an electrically conductive portion;

wherein the handles are rotatably mounted on a pin;

wherein the electrically conductive portions of the handles are forced together by a spring;

wherein a clamp cover is rotatably mounted on the pin.

15. The electrical clamp according to claim 14, wherein the clamp cover is capable of covering at least some of the electrically conductive portion.

16. The electrical clamp according to claim 14, wherein a force applied to the handles may overcome the force applied by the spring, wherein the electrically conductive portions are separated.

17. A clamp anchor, comprising:

an anchor base;

an anchor finger generally perpendicular to the anchor base; and wherein the clamp anchor is capable of receiving an electrical clamp that squeezes or pinches on the clamp anchor, wherein the electrical clamp comprises a rotatable clamp cover.

18. The clamp anchor according to claim 17, wherein the anchor finger has a groove therein.

19. A portable power supply, comprising:

a housing that encloses a battery;

booster cables protruding from the housing that are electrically connected to the battery;

electrical clamps connected to the booster cables, wherein the electrical clamps comprise clamp covers rotatably connected to the electrical clamps;

a clamp anchor integral or attached to the housing for the electrical clamps to pinch upon; and wherein the clamp anchor protrudes or extends from the surface of the housing.

20. The portable power supply according to claim 19, wherein the clamp anchor comprises a horizontal member and a vertical member, wherein the horizontal member is generally perpendicular to the vertical member, wherein the horizontal member and the vertical member are connected.

21. The portable power supply according to claim 20, wherein a groove is in the vertical member proximate to the horizontal member.

22. The portable power supply according to claim 20, wherein a box-groove is in the vertical member proximate to the horizontal member, and the box-groove comprises multiple surfaces parallel to the horizontal member.

23. The portable power supply of claim 19, wherein the clamp covers rotate to cover at least a portion of the clamp anchor.

24. A portable power supply, comprising:

a housing that encloses a battery;

booster cables protruding from the housing that are electrically connected to the battery;

electrical clamps connected to the booster cables, wherein the electrical clamps comprise clamp covers rotatably mounted to the electrical clamps; and a horizontal member and a vertical member that protrude or extend from the housing, and wherein the electrical clamps pinch on a combination of the horizontal member and the vertical member.

25. The portable power supply according to claim 24, wherein the horizontal member is generally perpendicular to the vertical member, wherein the horizontal member and the vertical member are connected.

26. The portable power supply according to claim 24, wherein a groove is in the vertical member proximate to the horizontal member.

27. The portable power supply according to claim 24, wherein a box-groove is in the vertical member proximate to the horizontal member, and the box-groove comprises multiple surfaces parallel to the horizontal member.

28. A portable power supply, comprising a housing that encloses a battery;

a booster cable protruding from the housing that is electrically connected to the battery;

an electrical clamp connected to the booster cable, wherein the electrical clamp comprises a rotatable clamp cover.

29. An electrical clamp, comprising:

handles having an electrically conductive portion;

wherein the handles are rotatably mounted on a pin;

wherein the electrical conductive portions of the handles are forced together by a spring; and the electrical clamp further comprises a rotatable clamp cover.

* * * * *